United States Patent [19]

Hajek

[11] 4,429,630

[45] Feb. 7, 1984

[54] PRINTING MACHINE MILLING ROLLER DRIVE SYSTEM

[75] Inventor: Josef Hajek, Friedberg, Fed. Rep. of Germany

[73] Assignee: M.A.N.-ROLAND Druckmaschinen Aktiengesellschaft, Offenbach am Main, Fed. Rep. of Germany

[21] Appl. No.: 460,309

[22] Filed: Jan. 24, 1983

[30] Foreign Application Priority Data

Feb. 4, 1982 [DE] Fed. Rep. of Germany ..... 3203803

[51] Int. Cl.[3] ..... B41F 13/12; B41F 7/26

[52] U.S. Cl. ..... 101/216; 101/148; 101/248

[58] Field of Search ..... 101/248, 247, 212, 216, 101/181, 148, 349–351

[56] References Cited

U.S. PATENT DOCUMENTS

| | | | |
|---|---|---|---|
| 2,447,872 | 8/1948 | Riggs et al. | 101/216 |
| 2,869,459 | 1/1959 | Bohme | 101/248 |
| 3,026,798 | 3/1962 | Frostad | 101/248 |
| 3,191,531 | 6/1965 | Worthington et al. | 101/148 X |
| 3,398,681 | 8/1968 | Hirose | 101/216 |
| 3,791,294 | 2/1974 | Skelding et al. | 101/248 |
| 3,817,176 | 6/1974 | Schultz | 101/350 |
| 4,000,691 | 1/1977 | Fischer | 101/177 X |
| 4,240,346 | 12/1980 | Landis et al. | 101/181 X |
| 4,385,559 | 5/1983 | Jarach | 101/148 |

FOREIGN PATENT DOCUMENTS

| | | |
|---|---|---|
| 2309850 | 9/1974 | Fed. Rep. of Germany . |
| 2514414 | 10/1976 | Fed. Rep. of Germany . |

*Primary Examiner*—E. H. Eickholt

*Attorney, Agent, or Firm*—Frishauf, Holtz, Goodman, & Woodward

[57] ABSTRACT

To provide a compact drive arrangement for a plurality of axially oscillating or reciprocating milling rollers (11, 12, 13) used in inkers and/or dampers of rotary printing machines, a central gear (16) is provided, driven from the plate cylinder (5) of the printing system, and wide enough to permit axial excursion of meshing gears (11', 12', 13') coupled to the respective milling rollers, and engaged with the central gear. To provide for axial excursion, the shaft (20) on which the central gear is located is connected with a right-angle drive to a transverse shaft (20) which is coupled to eccenters (35, 36, 37) which, in turn, are coupled by connecting rods (41, 42, 43) to a slider coupling (25, 26, 27; 28, 29, 30; 46, 47, 48) with the connecting rods, to thereby change rotary movement of the transverse shaft, driven in synchronism with the plate cylinder to longitudinal movement, while permitting adjustment of the phasing of the respective longitudinal drives by placing the relative position of the eccenters on the transverse shaft such that no oscillating or reciprocating roller will reach terminal dead center (TDC) position simultaneously with another milling roller, for example, for three rollers, by offsetting the eccenters 120° with respect to each other.

5 Claims, 4 Drawing Figures

PRINTING MACHINE MILLING ROLLER DRIVE SYSTEM

REFERENCE TO RELATED PUBLICATIONS

German Published Patent Applications
DE-AS 23 09 850, FISCHER
DE-AS 25 14 414, BARROIS et al.

The present invention relates to rotary printing machines, and more particularly to a drive arrangement suitable for a milling roller used, for example, in the inker or damper of the rotary printing machine, to provide for essentially uniform distribution of ink, or damping fluid, respectively, on a roller of the respective inker or damper.

BACKGROUND

Various types of liquid supply apparatus, typically inkers in various printing machines, as well as inkers and dampers in offset printing machines, utilize axially oscillating rollers which are driven from gearing on the plate cylinder of the printing machine. German Published Patent Application DE-AS 23 09 850, assigned to the assignee of the present application, describes an inker in which a plurality of milling rollers are included, all driven over a gear train from the plate cylinder. To obtain good distribution of ink on the milling rollers, some of the milling rollers are driven to oscillate in axial direction, by an axial drive. Such axial drives can be generated, for example as disclosed in German Published Patent Application DE-AS 25 14 414, by providing a separate drive mechanism for the axial movement. This can be expensive, and particularly so if the axial movement is subject to adjustment with respect to stroke of axial oscillation as well as phase position of the stroke with respect to predetermined circumferential positions of the plate cylinder.

THE INVENTION

It is an object to provide a compact drive arrangement for axially oscillating rollers in an inker and/or a damper, which is capable of providing both rotary drive for the axially oscillating roller as well as axially oscillating drive, both derived from the plate cylinder, and in which the stroke, as well as the phase position of any one axially oscillating milling roller with respect to another can be adjusted.

Briefly, a central gear is located to mesh with a gear on the plate cylinder, the central gear, in turn, providing rotary drive to a plurality of axially oscillating milling rollers. The axial oscillation of the milling rollers is obtained by coupling a right-angle drive with the central gear, placing individually adjustable eccenters on the output shaft of the right-angle drive and connecting the eccenter with connecting rods to coupling elements such as sliders, coupled to the respective rollers, to convert rotary motion into linear, reciprocating motion, while permitting adjustment of the stroke by locating the connecting rods at selected positions on the eccenter, and adjustment of relative phase of reciprocation by rotating the eccenters with respect to each other, for example by suitable adjustment of set screws with which the eccenters are coupled to the output of the right-angle drive.

The arrangement, in accordance with the invention, has the advantage that the central gear, which can readily be placed next to the plate cylinder, permits simple and compact construction of the rotary drive for the axially oscillating milling rollers of an inker and/or a damper. Additionally, the drive generates the axially oscillating movement for the milling rollers, permitting simple adjustment of the relative phase position and of the stroke of the axial excursion by merely adjusting the eccenter. Preferably, the eccenters are so rotated that the respective axially oscillating milling rollers never reach an end, or a terminal dead center (TDC) position at the same time; this has the advantage of contributing to uniformity of ink and/or damping fluid layers or films on the respective rollers. If three rollers are driven from the central gear, a relative eccenter adjustment of the drives for the three rollers is, preferably, a 120° respective phase position; for two rollers, a respective eccenter adjustment is, for example, 90°, which places the TDC position of one eccenter at the point of maximum acceleration of the other. Of course, any other adjustment position is equally possible and a suitable adjustment may depend on individual printing machine design requirements.

DRAWINGS

Figure 1:
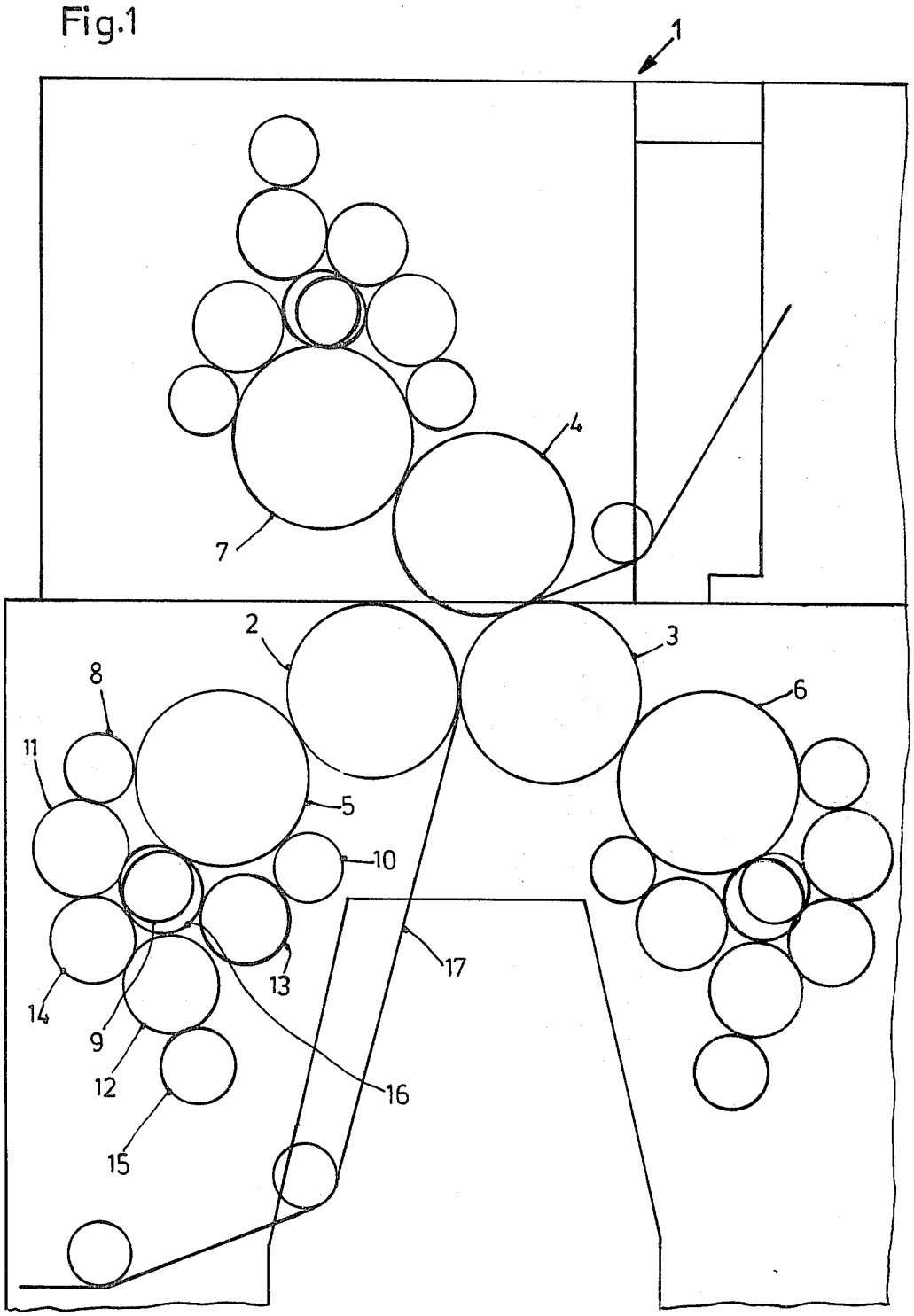
FIG. 1 is a schematic side view of a rotary offset printing machine, in which the inkers and dampers of only one printing station are shown in detail.

For purposes of illustration, a printing system 1 has three blanket cylinders 2, 3, 4, each of which cooperates with a plate cylinder 5, 6, 7, in engagement therewith. Each one of the plate cylinders 5–7 is associated with an inker and a damper, respectively. Only the rollers of the inker and damper which are adjacent the plate cylinder are shown in FIG. 5 - for simplicity of illustration - and only the system of inkers and dampers associated with plate cylinder 5 will be described in detail, and is specifically numbered. The systems associated with plate cylinders 6 and 7 can all be similar to that of plate cylinder 5, for example mirror-image reversed, laterally, or vertically, respectively.

Ink application rollers 8, 9 and a damper liquid application roller 10 are in engagement with the plate cylinder 5. The ink application rollers 8, 9 receive ink from ink milling rollers 11, 12, respectively; the damper application roller 10 receives damping liquid, typically water, over a damper milling roller 13. An ink distribution roller is located between the ink milling rollers 11, 12. Ink is supplied to one of the rollers of the inker, as shown to the milling roller 12, by an ink transfer roller 15, supplying ink from an ink trough, a ductor roller, or other suitable ink supply, which may be constructed in accordance with any suitable and well known arrangement.

A paper web 17 is guided between the blanket cylinders 3, 4 to apply two printing images by prime printing; blanket cylinder 3 applies one printing image by verso printing. Of course, other arrangements for web guiding are possible. As clearly seen in FIG. 1, the inker and damper arrangement associated with the plate cylinder 5 is equally suitable for association with plate cylinders 6 and 7. Making the various structures identical - with possibly merely reversal of parts in assembly - permits mass production of individual elements, and thus reduction of overall cost of the system.

The inker milling rollers 11 and 12, as well as the damper milling roller 13, are driven circumferentially by a central gear 16 (FIGS. 1, 2) which meshes with a gear 18 formed on plate cylinder 5, or on a shaft extension thereof.

Figure 2:
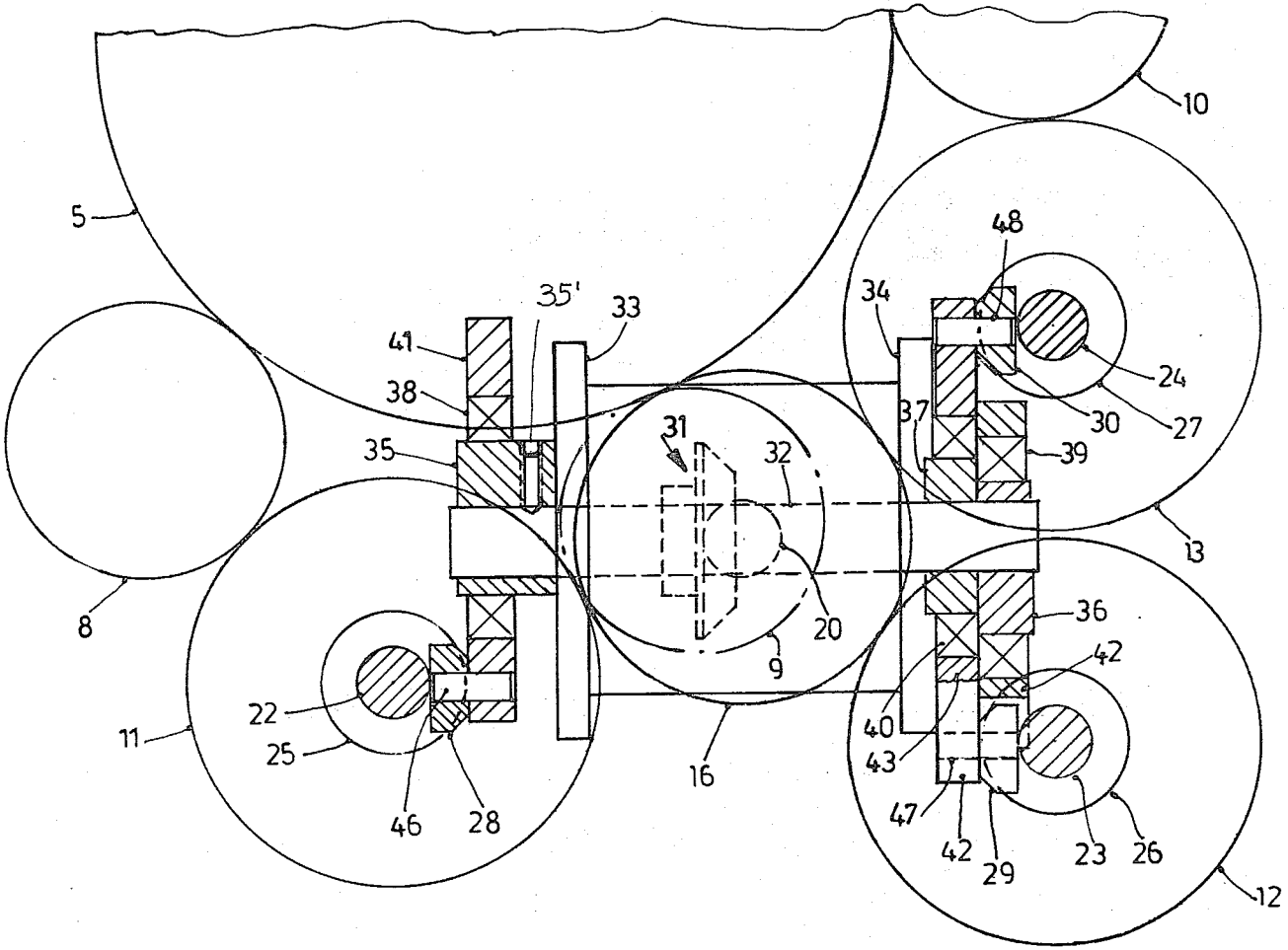
FIG. 2 is a side view of the drive for milling rollers, partly in section.
Figure 3:
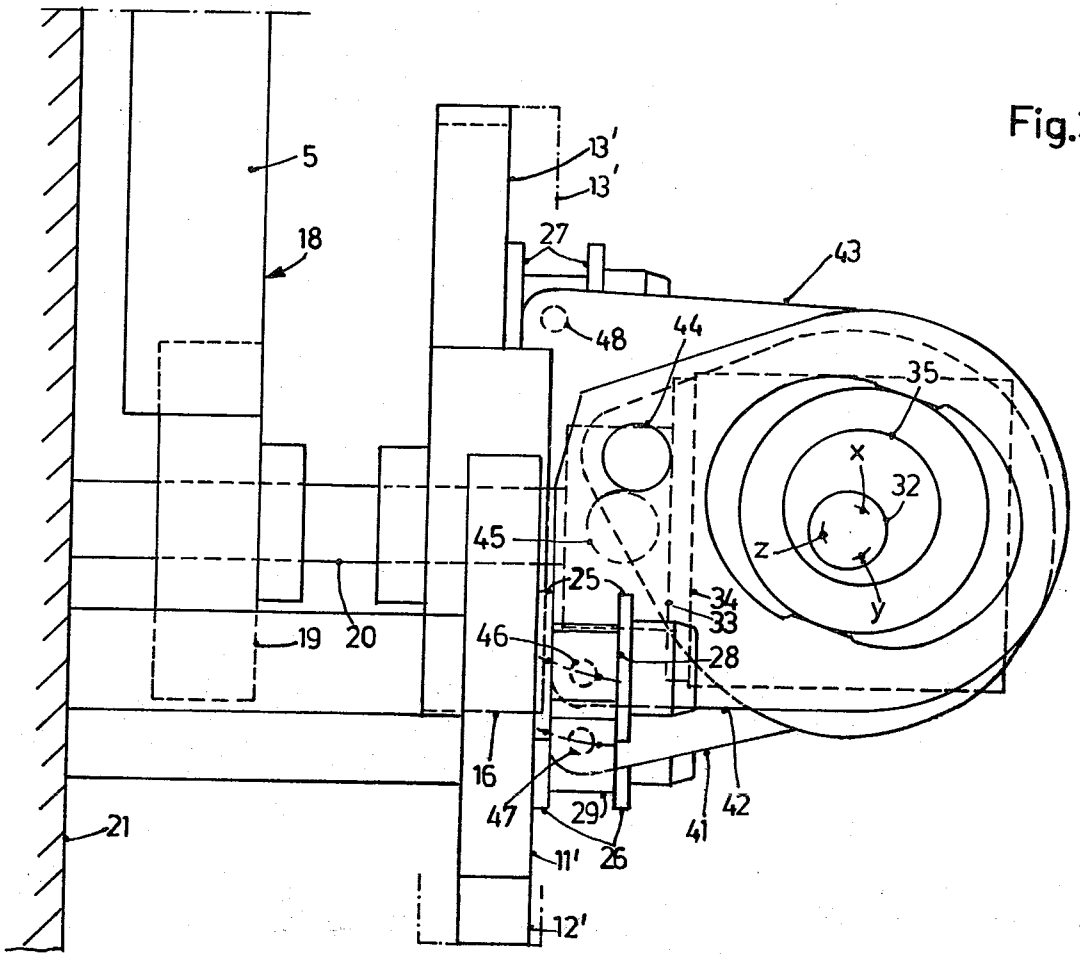
FIG. 3 is a side view of the drive mechanism, looked at from the left, of the milling section.
Figure 4:
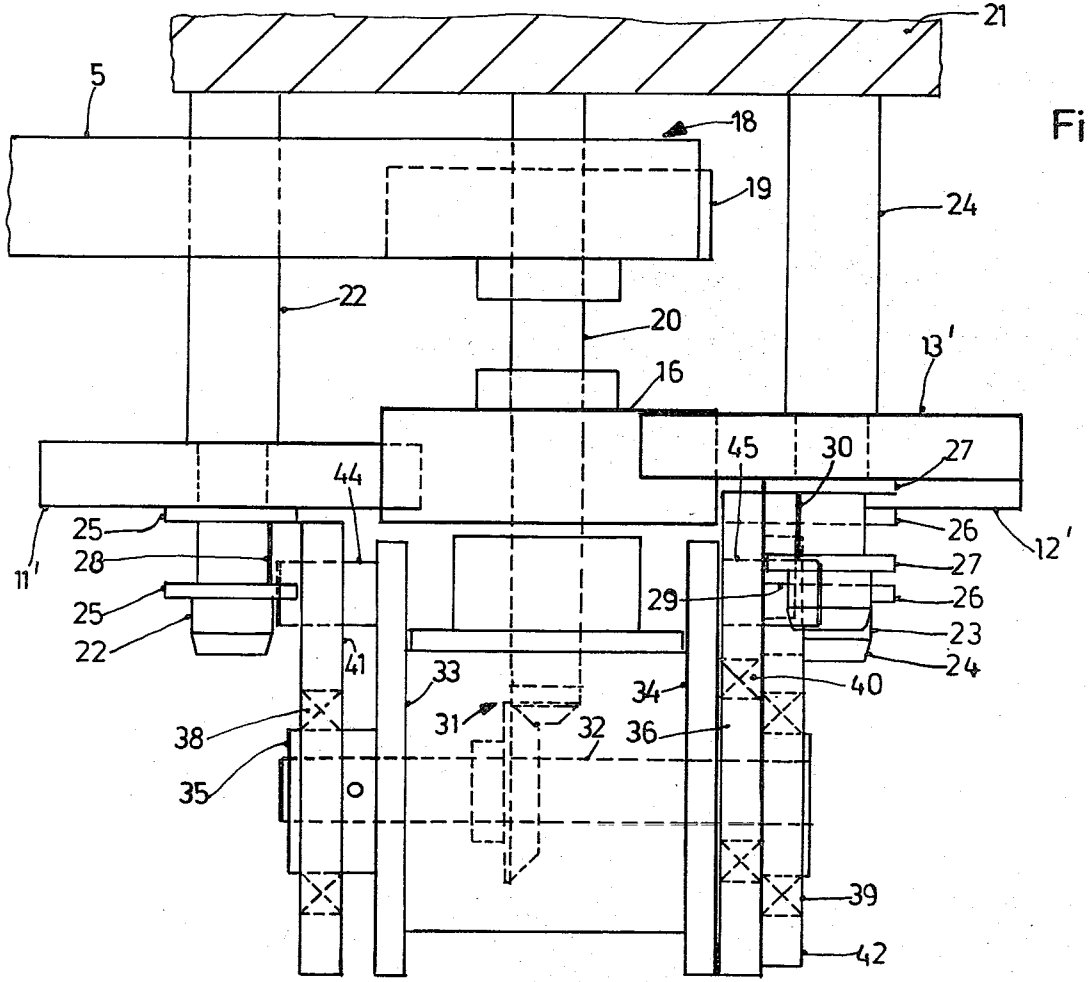
FIG. 4 is a top view of the drive shown in FIG. 2.

The details of the drive arrangement are best seen in FIGS. 2–4. The central gear 16 - FIGS. 2, 4 - is driven by plate cylinder 5 by engagement of a helical gear 19, secured to a shaft 20 on which gear 16 is seated, with a similar helical gearing 18 on the plate cylinder. Shaft 20 is journalled in the side wall or frame 21 of the printing machine in any well known and suitable manner, typically at side II, also known as the machine drive side.

Shaft 20, thus, retains and drives the central gear 16. Additionally, shaft 20 has secured thereto at an end portion thereof a right-angle drive 31 which drives a shaft 32, extending at right angles to shaft 20 (see particularly FIG. 4).

Drive gears 11', 12', 13' are secured to stub shafts 22, 23, 24 of the ink milling rollers 11 and 12, and the damping milling roller 13. The gears 11', 12', 13' mesh with the central gear 16, so that the milling rollers 11, 12, 13 are driven in synchronism with and in the rhythm of the plate cylinder 5. The central gear 16 is substantially wider than the gears 11', 12', 13' in order to insure rotation of the respective milling rollers 11, 12, 13 even if the axial position of the milling rollers, and hence of the gears secured thereto, changes. Other arrangements, such as longitudinal splining, of course, may be used.

Drive disks 25, 26, 27 are located on the stub shafts 22, 23, 24 adjacent the gears 11', 12', 13'. The drive disks 25, 26, 27 are, respectively, engaged by sliding blocks 28, 29, 30.

Shaft 32 - FIGS. 2 and 4 - is journalled at both sides laterally of shaft 20, so that shaft 32 will be retained in right-angle position with respect to shaft 20. The left side of shaft 32 has an eccenter 35 secured thereto - see FIGS. 2 and 4; the right end of the shaft 32 carries two eccenters, namely eccenter 36 and, adjacent thereto, an eccenter 37. The eccenters 35, 36, 37 are secured to rotate with the shaft 32 by set screws which, however, can be loosened, so that the respective eccenters 35, 36, 37 can be rotated relative to each other on the shaft 32. By suitably positioning the eccenters 35, 36, 37 on the shaft 32, individual temporal adjustment of axial oscillation is possible; thus, the relative phasing of axial oscillation of the milling rollers can be adjusted. Preferably, eccenters 35, 36, 37 are so adjusted that the respective milling rollers 11, 12, 13 never reach their terminal dead center or reversal or end position at the same time. FIG. 3 illustrates by the letters X, Y, Z a preferred positioning of the three eccenters 35, 36, 37 in schematic representation. Set screw 35' is shown in FIG. 2 as an example permitting adjustment.

Bearings 38, 39, 40 are located on the eccenters 35, 36, 37. These bearings are shown fixed, but may be placed radially adjustably on the eccenters. As best seen in FIGS. 2 and 4, connecting rods 41, 42, 43 are secured to the bearings 38, 39, 40; the connecting rod 42 is longitudinally offset, or bent out-of-alignment, since the milling rollers 12 and 13 are located above each other.

The connecting rods 41, 42, 43 are held in position on attachment plates 33. FIGS. 3 and 4 illustrate the respective attachments 44, 45 for the connecting rods 41, 42; a similar attachment is provided for connecting rod 43, but has been omitted from the drawings for clarity.

As best seen in FIG. 2, each one of the connecting rods 41, 42, 43 has a pin or stub 46, 47, 48 attached thereto which is coupled to the respective slider blocks 28, 29, 30.

Operation: Upon rotation of plate cylinder 5, transmitted via gearing 18/19 to shaft 20, the right-angle drive 31 will rotate the right-angle shaft 32 which is held in position, for example, in attachment plates 33, 34 secured to the frame of the machine in any suitable and well known manner. Upon rotation of shaft 32, eccenters 35, 36, 37 will rotate and impart to the connecting rods 41, 42, 43 - which need not be in form of a straight rod - a reciprocating motion extending in axial direction with respect to the milling rollers 11, 12, 13, which motion is transferred via sliding blocks 28, 29, 30 to the stub shafts 22, 23, 24 of the respective milling rollers 11, 12, 13. Consequently, the milling rollers 11, 12, 13 are axially reciprocated or oscillated with respect to the side walls of the machine - only schematically shown in FIGS. 3 and 4, and within which the milling rollers are journalled. The central gear 16, which is substantially wider than the drive gears 11', 12', 13', insures reliable rotation of the milling rollers at any axial position thereof.

Various changes and modifications may be made within the scope of the inventive concept.

I claim:

1. In a rotary printing machine having a frame (21);

a plate cylinder (5, 6, 7) and gear means (18) rotating therewith, a drive system for a plurality of axially oscillating milling rollers (11, 12, 13)

comprising, in accordance with the invention, means (22, 23, 24) for rotatably journalling the milling rollers while permitting axial excursion;

a central gear (16) driven to rotate with the plate cylinder gear means (18);

a central drive shaft (20) driven by the central gear;

a plurality of drive gears (11', 12', 13') meshing with said central gear and providing rotation for respectively associated milling rollers (11, 12, 13);

a right-angle drive (31) coupled to rotate with the shaft (20) of the central gear (16) and having an output shaft (32);

a plurality of circumferentially adjustable rotatable eccenters (35, 36, 37), one for each milling cylinder, secured to the output shaft (32);

connecting rod means (41, 42, 43) journalled on the eccenter at one end thereof and converting rotary movement of the eccenter into linear movement;

and engagement coupling means (46, 47, 48; 28, 29, 30; 25, 26, 27) coupling the other end of the respective connecting rods to the respective milling rollers for longitudinal oscillatory movement thereof in the rhythm of rotation of the plate cylinder.

2. Drive system according to claim 1, further comprising bearings (38, 39, 40), the connecting rods being rotatably secured in said bearings.

3. Drive system according to claim 1, wherein the engagement and coupling means between the connecting rods (41, 42, 43) and the milling rollers (11, 12, 13) comprises guide disks (25, 26, 27) secured to the milling rollers (11, 12, 13);

slider blocks (28, 29, 30) in engagement with the guide disks;

and connecting pins (46, 47, 48) respectively connecting the connecting rods and the slider blocks.

4. Drive system according to claim 3, wherein the means rotatably journalling the milling rollers comprises stub shafts (22, 23, 24), the guide disks (25, 26, 27) being secured to the stub shafts.

5. Drive system according to claim 1, wherein the milling rollers comprise two ink milling rollers (11, 12) and a damping fluid milling roller (13).

* * * * *